US008914980B2

(12) United States Patent
Solomennikov

(10) Patent No.: US 8,914,980 B2
(45) Date of Patent: Dec. 23, 2014

(54) RAZOR

(76) Inventor: Oleg Yurievich Solomennikov, Noginsk (RU)

( * ) Notice: Subject to any disclaimer, the term of this patent is extended or adjusted under 35 U.S.C. 154(b) by 596 days.

(21) Appl. No.: 13/058,967

(22) PCT Filed: Dec. 17, 2008

(86) PCT No.: PCT/RU2008/000773

§ 371 (c)(1),
(2), (4) Date: Feb. 14, 2011

(87) PCT Pub. No.: WO2010/019071

PCT Pub. Date: Feb. 18, 2010

(65) Prior Publication Data

US 2011/0146081 A1 Jun. 23, 2011

(30) Foreign Application Priority Data

Aug. 12, 2008 (RU) ..... 2008132961

(51) Int. Cl.
*B26B 21/00* (2006.01)
*B26B 21/28* (2006.01)

(52) U.S. Cl.
CPC ..... *B26B 21/28* (2013.01)
USPC ..... 30/48; 30/49; 30/50

(58) Field of Classification Search
CPC ..... B26B 21/00; B26B 21/028; B26B 21/10; B26B 21/24
USPC ..... 30/47–50
See application file for complete search history.

(56) References Cited

U.S. PATENT DOCUMENTS

| | | | | | |
|---|---|---|---|---|---|
| 1,226,614 | A | * | 5/1917 | Hiskey | 30/49 |
| 1,726,570 | A | * | 9/1929 | Keene | 30/49 |
| 1,824,338 | A | * | 9/1931 | Finn | 30/48 |
| 2,156,559 | A | * | 5/1939 | Oldham et al. | 30/74.1 |
| 2,315,785 | A | * | 4/1943 | Greenleaf | 30/50 |
| 2,342,291 | A | * | 2/1944 | Morelli | 30/50 |
| 2,382,296 | A | * | 8/1945 | Crowell | 30/47 |
| 2,565,062 | A | * | 8/1951 | Blanchard | 30/32 |
| 3,137,940 | A | * | 6/1964 | Curci | 30/40 |
| 3,466,746 | A | * | 9/1969 | Dawidowicz et al. | 30/60.5 |
| 3,722,091 | A | * | 3/1973 | Gagnon | 30/40 |
| 4,501,066 | A | * | 2/1985 | Sceberras | 30/50 |
| 4,599,793 | A | * | 7/1986 | Iten | 30/47 |

(Continued)

FOREIGN PATENT DOCUMENTS

| | | | |
|---|---|---|---|
| RU | 2161088 | C2 | 12/2000 |
| RU | 61625 | U1 | 3/2007 |
| RU | 2006134514 | A | 4/2008 |

*Primary Examiner* — Ghassem Alie
*Assistant Examiner* — Bharat C Patel
(74) *Attorney, Agent, or Firm* — Alexander Rabinovich

(57) ABSTRACT

A razor has a holder, a holder handle defining a razor axis, a cross-piece installed in the holder along the razor axis, and up to four pairs of blades. The holder and holder handle collectively form a T-shape structure. Each of the blades in each of the pairs is installed in the holder on a respective side of the cross-piece and at sharp blade setting angle and symmetrical about the cross-piece. The blade setting angle is 75-80°, and the blade setting angle of each preceding blade pair in the direction of the razor movement is less than the setting angle of a subsequent blade pair. The invention makes it possible to increase the efficiency and ease of shaving and to reduce the production cost of the razor.

2 Claims, 2 Drawing Sheets

(56) References Cited

U.S. PATENT DOCUMENTS

| | | | | | |
|---|---|---|---|---|---|
| 4,663,843 | A | * | 5/1987 | Savage | 30/48 |
| 4,791,724 | A | * | 12/1988 | Dumas | 30/526 |
| 4,854,042 | A | * | 8/1989 | Byrne | 30/34.1 |
| 4,901,437 | A | * | 2/1990 | Iten | 30/50 |
| 4,980,974 | A | * | 1/1991 | Radcliffe | 30/50 |
| 5,133,131 | A | * | 7/1992 | Hoffman | 30/50 |
| 5,307,564 | A | * | 5/1994 | Schoenberg | 30/50 |
| 5,426,853 | A | * | 6/1995 | McNinch | 30/527 |
| 5,522,137 | A | * | 6/1996 | Andrews | 30/50 |
| 5,579,580 | A | * | 12/1996 | Althaus et al. | 30/50 |
| D378,147 | S | * | 2/1997 | Hegemann | D28/46 |
| 5,848,475 | A | * | 12/1998 | Hill et al. | 30/527 |
| 6,055,731 | A | * | 5/2000 | Zucker | 30/49 |
| 6,082,007 | A | * | 7/2000 | Andrews | 30/50 |
| 6,161,288 | A | * | 12/2000 | Andrews | 30/50 |
| 6,263,576 | B1 | * | 7/2001 | Drapak et al. | 30/48 |
| 6,418,623 | B1 | * | 7/2002 | Marcarelli | 30/50 |
| 6,519,856 | B1 | * | 2/2003 | Dischler | 30/48 |
| 6,823,594 | B2 | * | 11/2004 | Kludjian et al. | 30/526 |
| 7,918,027 | B2 | * | 4/2011 | Colthurst | 30/50 |
| 2003/0182802 | A1 | * | 10/2003 | Vega et al. | 30/50 |
| 2004/0231161 | A1 | * | 11/2004 | Coffin et al. | 30/50 |
| 2005/0166404 | A1 | * | 8/2005 | Colthurst | 30/50 |
| 2007/0220755 | A1 | * | 9/2007 | Dror | 30/42 |

* cited by examiner

RAZOR

CROSS-REFERENCE TO RELATED APPLICATIONS

This application is a U.S. National phase application of the International application WO 2010/019071 A1 (PCT/RU2008/000773) and claims priority to application 2008132961 filed on Aug. 12, 2008, in the Russian Federation, both applications being hereby incorporated by reference in their entirety.

BACKGROUND OF THE INVENTION

1. Field of the Invention

The invention relates to portable cutting tools, namely to safety razors.

2. Description of the Related Art

Known is a razor, which contains a holder with handle and at least one pair of blades installed in the holder at a sharp angle symmetrically about the longitudinal axis of the razor (see patent RU 2161088, C1. B26B21/00, published Dec. 27, 2000). Disadvantages of the known device are the unreliable locking of blades located in the central part of the holder, presence of sharp cutting angle within this part and non-optimal selection of blade setting angle. Affording to the customer himself the opportunity to control the angle is not a satisfactory solution of the problem. The retainer holding the blade in the selected position wears out in the course of time and cannot ensure the reliable securing. Besides, the user is not an expert in assessing the efficiency of the selected angle setting, and the optimal angle should be determined for maximum convenience during multiple checks conducted prior to the production of the razor.

SUMMARY OF THE INVENTION

The object of the invention is to eliminate the above-mentioned disadvantages. The technical result consists in increasing comfort and effectiveness of shaving, as well as in reducing material expenses for production of the razor. The object and the technical result are achieved in the razor comprising a holder with a handle and at least one pair of blades by installing the blades in the holder at a sharp angle and symmetric about a razor axis, by providing in the center of the holder a cross-piece, which fixes the blade setting, and by selecting the blade setting angle within 75-80°.

It is preferable that the razor contain between two and four pairs of blades with different angle setting. It is expedient that the setting angle of each previous pair of blades in the direction of the razor movement be less than the setting angle of the next pair of blades.

BRIEF DESCRIPTION OF THE DRAWINGS

The concept of the present invention will be better understood by referring to the following drawings wherein.

DETAILED DESCRIPTION OF THE INVENTION

Figure 1:
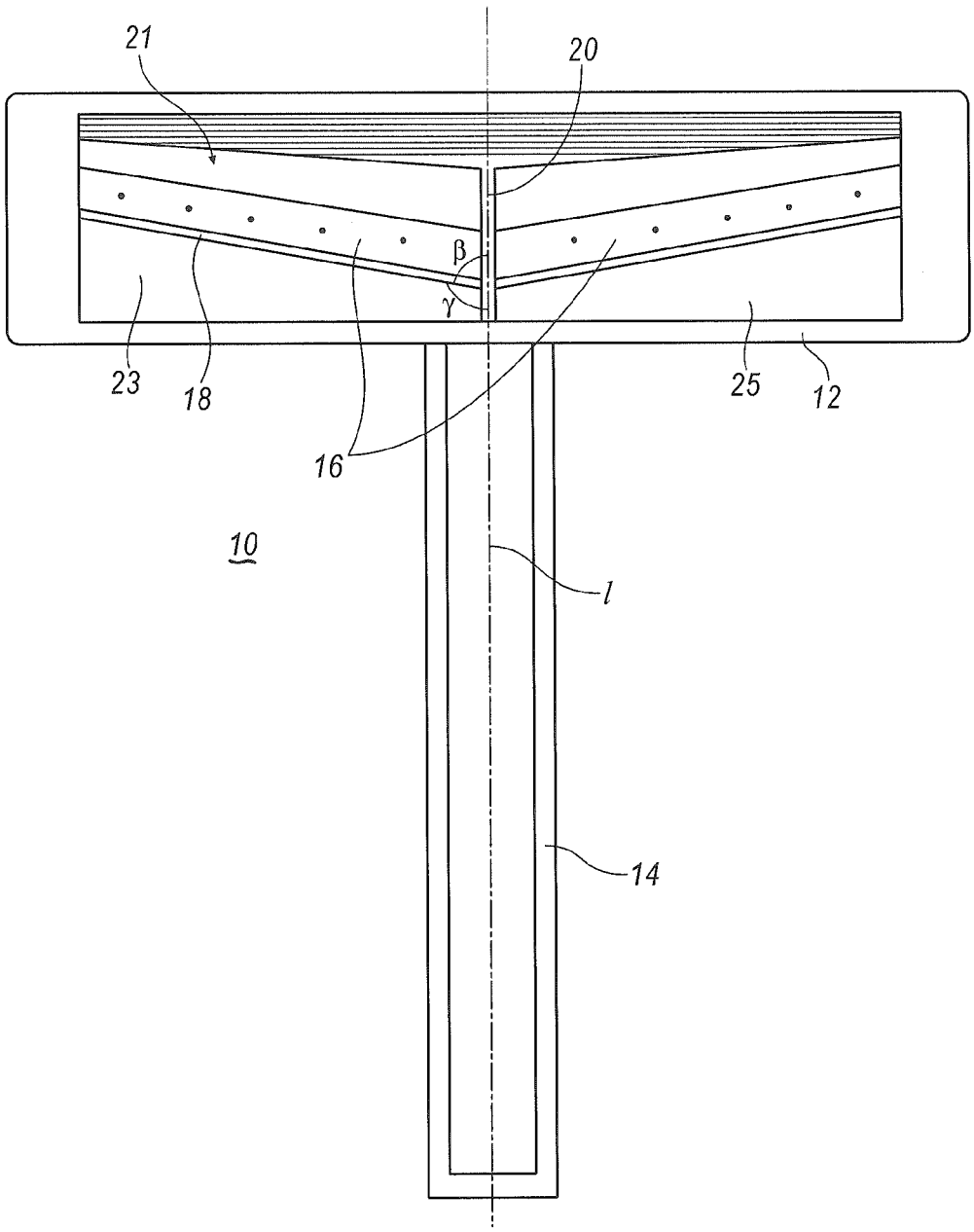
FIG. 1 presents the basic concept of the razor.

Referring to FIG. 1, illustrating the basic concept of the razor according to the present invention, the razor 10 comprises a holder 12 with a handle 14, defining a longitudinal axis l of the razor. A pair of blades, 16, with cutting edges 18 is installed in the holder 12, the blades in the pair being symmetric to each other about the longitudinal axis/and being at a sharp setting angle β about the axis 1. The sharp setting angle β is within 75-80°, whereas an angle γ complementing angle β is an obtuse one, respectively. The holder is made with a cross-piece (bar) 20 in the holder center. The bar 20 is aligned with the axis l and fixes the blade setting. The cross-piece (bar) 20 divides a space 21 defined by the holder 12 into two subspaces 23 and 25, each of the blades 16 of the pair being situated in the respective subspace.

Figure 2:
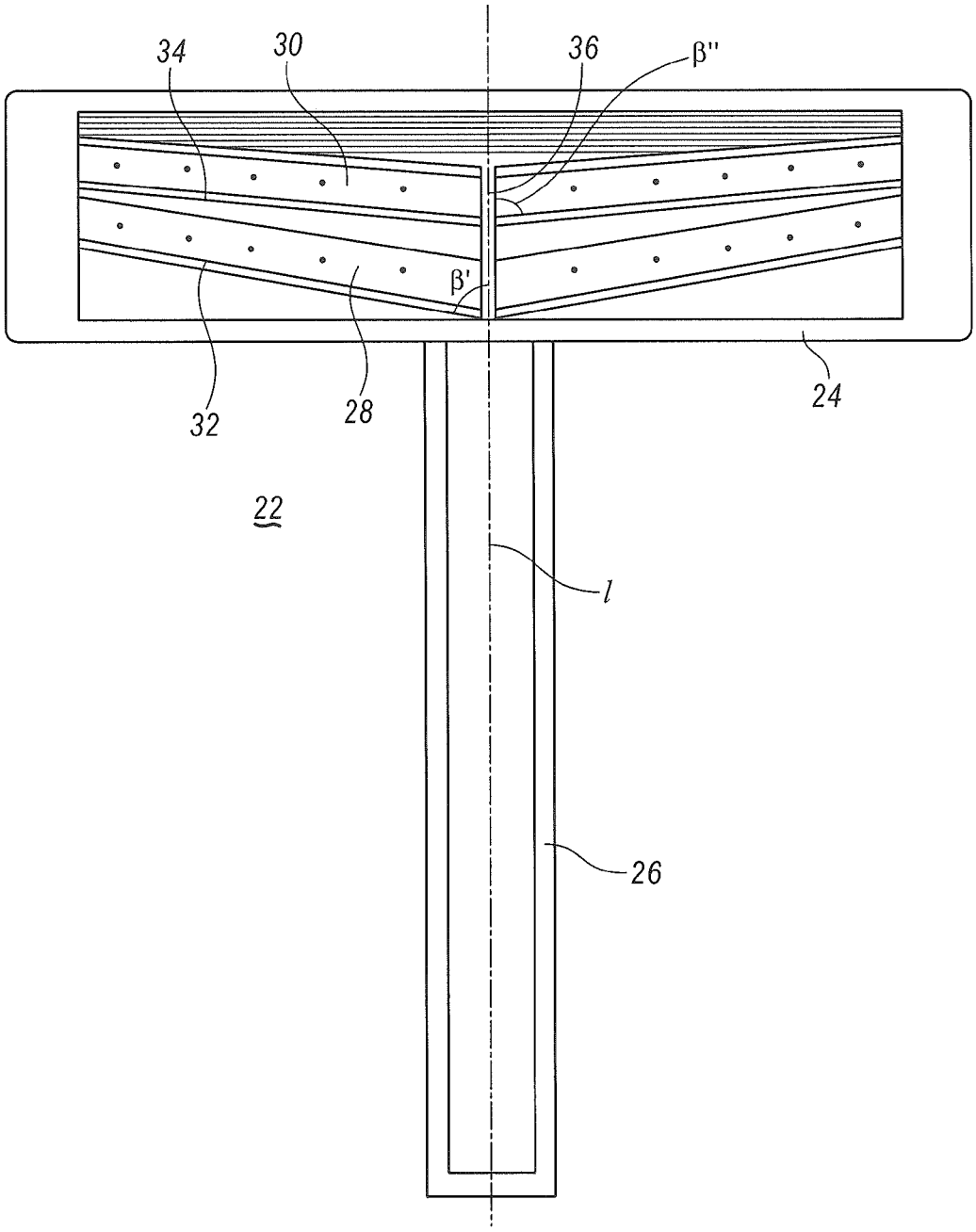
FIG. 2 illustrates an embodiment with two pairs of blades.

Referring to FIG. 2 where another embodiment of the razor is shown, the razor 22 comprises a holder 24 with a handle 26. Two pairs 28 and 30 of blades, with cutting edges 32, 34, respectively, are installed in the holder 24, the blades in each of the pairs being symmetric to each other about a longitudinal axis l of the razor and being at sharp setting angles β' and β" about the axis l. The angle of setting of each preceding pair in the direction of the razor movement is less than the setting angle of a succeeding one, so the preceding blade pair 28 setting angle β' may be, for example, made equal 75°, and the setting angle β" of blade pair 30-80°. The holder is made with a cross-piece (bar) 36 in the holder center. The bar 36 is aligned with axis l and fixes the blade setting.

The number of blade pairs may reach four.

The razor 10 operates as follows.

As it moves along the surface being processed, the hairs are being shifted along the cutting edge, thus increasing the cutting capacity of the blade. Thus, the requirements for grinding the blade and quality of steel imposed upon traditional razors with blades perpendicular to the longitudinal axis can be reduced. Additionally, the traditional location of the cutting edge at straight angle results in its rapid wear and respectively in the reduction of the shaving quality.

The tests that were conducted showed that the setting angle of 75-80° is optimal. At a greater angle, the effect of shifting hairs along the blade edge practically disappears, and the razor becomes similar to traditional ones. At a smaller angle, the probability of cutting the skin sharply increases which adversely affects the comfort of shaving.

The symmetrical setting of blades at an angle to the longitudinal axis l of the razor forms cutting corner in the holder center, which is able to hurt the skin. If the razor contains several pairs of blades, each of which extends from the upper (as shown in the drawing) edge of the holder to the lower one, a region is formed in the center, which is processed by the first blade in the direction of the razor movement. Thus the efficiency of the razor can be substantially reduced in the center of the processing zone. This disadvantage is eliminated by making the holder with the cross-piece in the center of the holder to thereby camouflage the cutting corner.

Researches show that using from two to four pairs of blades in the razor is optimal. Setting these pairs at differing angles makes it possible to effectively cut hairs growing in different directions. Moving the razor opposite the direction of the hair growth results in better shaving. In this case, if the setting angle of the first pair of blades in direction of movement is less than those in other blade pairs, most of hairs are immediately cut out at the optimal angle. The second blade pair located at a larger angle shaves hairs growing at a small angle to the direction of the main growth. The third pair of blades shaves hairs growing at a greater angle, and so on. In this case, the described sequence of the setting angles provides for maximum efficiency of shaving at the first stage and increasing further the quality of shaving by next blades. If the blades are set in reverse order, the shaving quality is sharply reduced.

Thus, the razor allows to sufficiently increase the efficiency and comfort of shaving, as it becomes almost painless, as well as to reduce the material expenses for the production of the razor since it makes it possible to use blades with grinding from steel of lower quality.

The invention claimed is:

1. A razor, comprising:

a holder and a holder handle the holder handle defining a razor axis the holder defining a space therein and comprising a bar dividing the space into two subspaces and aligned with the razor axis, and at least one pair of blades, each of the blades of the at least one pair being installed in the holder in a respective subspace of said two subspaces, on a respective side of the bar symmetrical to each other about the bar, and at a blade setting angle to the bar, the blade setting angle being a sharp blade setting angle when viewed from the holder in the direction to the handle and being an obtuse blade setting angle supplementing said sharp blade setting angle when viewed from the handle in the direction to the holder, wherein the at least one pair of blades includes two pairs of blades and the sharp blade setting angle of a preceding blade pair with regard to the direction of razor movement is being less than the blade setting angle of a subsequent blade pair.

2. A razor, comprising:

a holder defining a space therein, a holder handle defining a razor axis, a bar in the holder dividing the space into two subspaces and aligned with the razor axis, and at least two pairs of blades, one of the blades in each of the pairs being installed in the holder in one of the subspaces and on one side of the bar, another blade in each of the pairs being installed in the other subspace on the opposite side of the bar, the blades in each of the pairs being symmetrical to each other about the bar at a sharp blade setting angle of 75-80° to the bar when viewed from the holder in the direction of the handle, and at an obtuse blade setting angle supplementing said sharp blade setting angle when viewed from the handle in the direction of the holder, wherein the blade setting angle of each preceding blade pair in the direction of razor movement is less than the blade setting angle of a subsequent blade pair.

* * * * *